US011802693B2

(12) United States Patent
Danis et al.

(10) Patent No.: US 11,802,693 B2
(45) **Date of Patent: *Oct. 31, 2023**

(54) COMBUSTOR SWIRL VANE APPARATUS

(71) Applicant: General Electric Company, Schenectady, NY (US)

(72) Inventors: Allen M. Danis, Mason, OH (US); Nicholas R. Overman, Cincinnati, OH (US); Steven Clayton Vise, Loveland, OH (US); Michael Anthony Benjamin, Cincinnati, OH (US); James Matthew Rogers, Loveland, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 130 days.

This patent is subject to a terminal disclaimer.

(21) Appl. No.: 17/232,653

(22) Filed: Apr. 16, 2021

(65) Prior Publication Data

US 2022/0333780 A1 Oct. 20, 2022

(51) Int. Cl.

| | |
|---|---|
| ***F23R 3/14*** | (2006.01) |
| ***F23D 14/62*** | (2006.01) |
| ***F23R 3/28*** | (2006.01) |

(52) U.S. Cl.

CPC ..... *F23R 3/14* (2013.01); *F23D 14/62* (2013.01); *F23R 3/286* (2013.01); *F23D 2206/10* (2013.01); *F23D 2900/14021* (2013.01); *F23D 2900/14701* (2013.01)

(58) Field of Classification Search

CPC .. F23R 3/14; F23R 3/286; F23D 14/62; F23D 2900/14021; F23D 2900/14701

See application file for complete search history.

(56) References Cited

U.S. PATENT DOCUMENTS

| | | | | |
|---|---|---|---|---|
| 3,618,317 | A | 11/1971 | Du Bell | |
| 3,915,387 | A * | 10/1975 | Caruel | F23R 3/14 239/404 |
| 4,653,278 | A * | 3/1987 | Vinson | F23R 3/28 60/737 |
| 5,186,607 | A * | 2/1993 | Yang | F23R 3/14 415/208.1 |
| 5,490,378 | A | 2/1996 | Berger et al. | |
| 5,941,075 | A | 8/1999 | Ansart et al. | |
| 5,966,937 | A * | 10/1999 | Graves | F23R 3/14 239/406 |
| 6,119,459 | A * | 9/2000 | Gomez | F23C 7/004 60/748 |

(Continued)

*Primary Examiner* — Lorne E Meade

(74) *Attorney, Agent, or Firm* — Venable LLP; Peter T. Hrubiec; Michele V. Frank

(57) ABSTRACT

A swirler apparatus for a combustor, including: primary and secondary swirlers disposed axially adjacent to each other along a swirler centerline; the primary swirler including a plurality of primary swirl vanes arrayed around the swirler centerline, each primary swirl vane including opposed sides bounded between opposed forward and aft edges and opposed leading and trailing edges; wherein the forward edge is oriented at a first vane angle with respect to a radial direction; wherein the aft edge is oriented at a second vane angle with respect to the radial direction; wherein the second vane angle is different from the first vane angle; and the secondary swirler including a plurality of secondary swirl vanes arrayed around the swirler centerline.

20 Claims, 8 Drawing Sheets

(56) References Cited

U.S. PATENT DOCUMENTS

| | | | | |
|---|---|---|---|---|
| 6,141,967 | A * | 11/2000 | Angel | F23R 3/14 60/737 |
| 6,374,593 | B1 * | 4/2002 | Ziegner | F23D 23/00 60/737 |
| 6,502,399 | B2 * | 1/2003 | Mandai | F23R 3/14 60/747 |
| 6,834,505 | B2 | 12/2004 | Al-Roub et al. | |
| 6,932,093 | B2 * | 8/2005 | Ogden | F23D 11/386 134/198 |
| 7,093,445 | B2 * | 8/2006 | Corr, II | F23R 3/286 60/737 |
| 7,104,066 | B2 | 9/2006 | Leen et al. | |
| 7,581,396 | B2 * | 9/2009 | Hsieh | F23R 3/286 60/776 |
| 7,721,437 | B2 | 5/2010 | Howell et al. | |
| 8,312,723 | B2 | 11/2012 | Pieussergues et al. | |
| 8,347,630 | B2 | 1/2013 | Lovett et al. | |
| 8,590,312 | B2 | 11/2013 | Sandelis | |
| 9,927,124 | B2 | 3/2018 | Stuttaford et al. | |
| 9,989,256 | B2 | 6/2018 | Sandellis et al. | |
| 2005/0229600 | A1 | 10/2005 | Kastrup et al. | |
| 2007/0028624 | A1 * | 2/2007 | Hsieh | F23R 3/14 60/776 |
| 2016/0201918 | A1 | 7/2016 | Jella et al. | |

* cited by examiner

COMBUSTOR SWIRL VANE APPARATUS

BACKGROUND OF THE INVENTION

The present invention relates generally to combustors, and more particularly to gas turbine engine combustor swirlers.

A gas turbine engine typically includes, in serial flow communication, a low-pressure compressor or booster, a high-pressure compressor, a combustor, a high-pressure turbine, and a low-pressure turbine. The combustor generates combustion gases that are channeled in succession to the high-pressure turbine where they are expanded to drive the high-pressure turbine, and then to the low-pressure turbine where they are further expanded to drive the low-pressure turbine. The high-pressure turbine is drivingly connected to the high-pressure compressor via a first rotor shaft, and the low-pressure turbine is drivingly connected to the booster via a second rotor shaft.

One type of prior art combustor includes an annular dome interconnecting the upstream ends of annular inner and outer liners. These may be arranged, for example, as "single annular combustors" having one dome, "double annular combustors" having two domes, or "triple annular" combustors having three domes.

Typically, each dome is provided with an array of air swirler assemblies. One type of swirler assembly includes axially-adjacent primary and secondary radial-inflow swirlers. The primary and secondary swirlers each include a flow channel having a radial array of vanes positioned therein. The vanes are oriented so as to produce a swirl in the air passing through the flow channel. Typically, such vanes have a constant vane angle, i.e., they produce a constant swirl magnitude and direction.

BRIEF DESCRIPTION OF THE INVENTION

According to one aspect of the technology described herein, a swirler apparatus for a combustor comprises: primary and secondary swirlers disposed axially adjacent to each other along a swirler centerline; the primary swirler including a plurality of primary swirl vanes arrayed around the swirler centerline, each primary swirl vane including opposed sides bounded between opposed forward and aft edges and opposed inboard and outboard edges; wherein the forward edge is oriented at a first vane angle with respect to a radial direction; wherein the aft edge is oriented at a second vane angle with respect to the radial direction; wherein the second vane angle is different from the first vane angle; and the secondary swirler including a plurality of secondary swirl vanes arrayed around the swirler centerline.

According to another aspect of the technology described herein, combustor for a gas turbine engine includes: an annular inner liner; an annular outer liner spaced apart from the inner liner; a domed end disposed at an upstream end of the inner and outer liners, the domed end including an annular dome; the dome including an annular array of swirler assemblies, each swirler assembly having primary and secondary swirlers disposed axially adjacent to each other along a swirler centerline; the primary swirler including a plurality of primary swirl vanes arrayed around the swirler centerline, each primary swirl vane including opposed sides bounded between opposed forward and aft edges and opposed leading and trailing edges; wherein the forward edge is oriented at a first vane angle with respect to a radial direction; wherein the aft edge is oriented at a second vane angle with respect to the radial direction; wherein the second vane angle is different from the first vane angle; and the secondary swirler including a plurality of secondary swirl vanes arrayed around the swirler centerline.

According to another aspect of the technology described herein, a swirler apparatus for a combustor includes: primary and secondary swirlers disposed axially adjacent to each other along a swirler centerline; the primary swirler including a plurality of primary swirl vanes arrayed around the swirler centerline, each primary swirl vane including opposed sides bounded between opposed forward and aft edges and opposed leading and trailing edges, wherein the forward edge is oriented at a first vane angle with respect to a radial direction of less than 40 degrees; wherein the aft edge is oriented at a second vane angle with respect to the radial direction of less than 40 degrees; the secondary swirler including a plurality of secondary swirl vanes arrayed around the swirler centerline.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
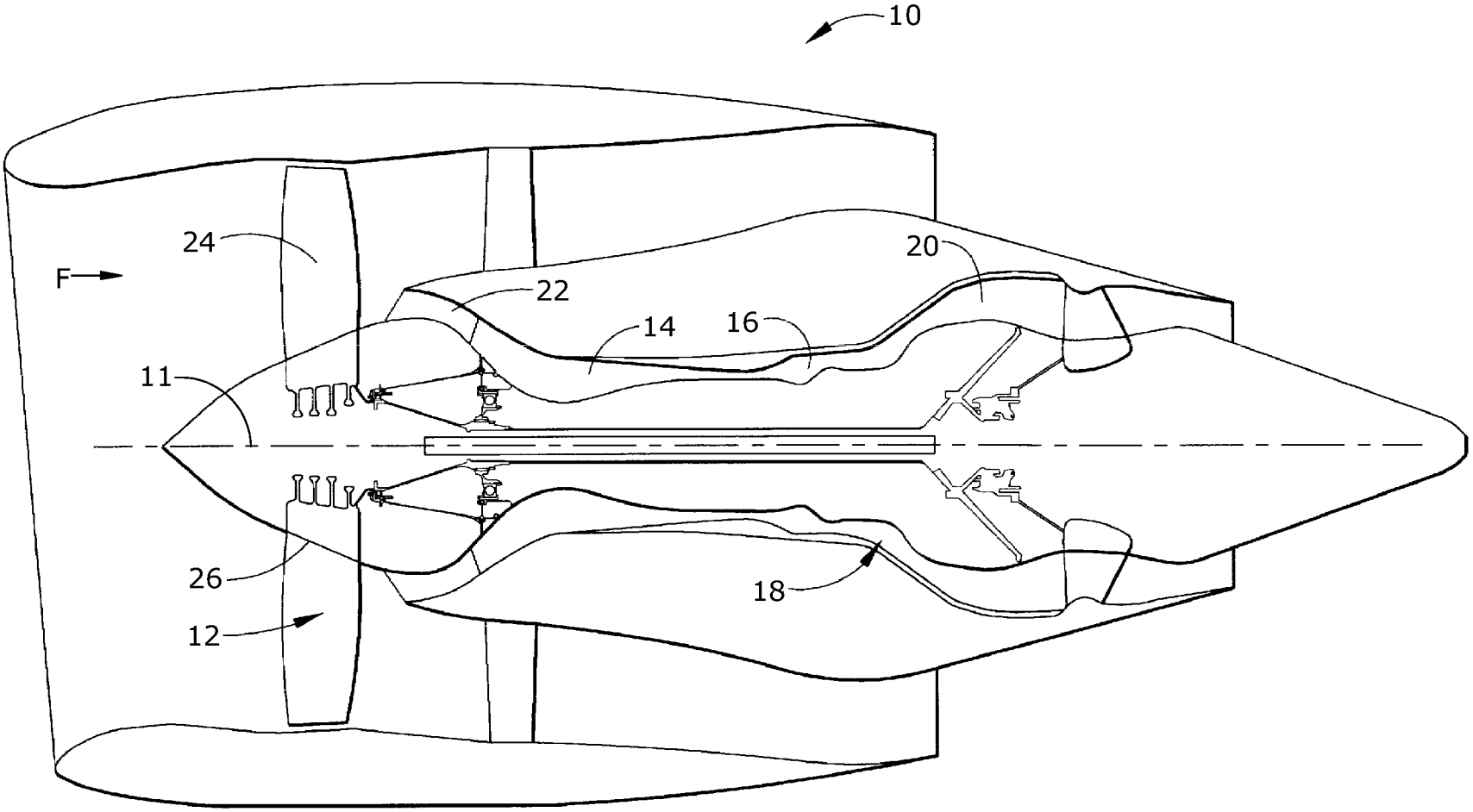
FIG. 1 is a schematic illustration of a gas turbine engine.

Referring to the drawings wherein identical reference numerals denote the same elements throughout the various views, FIG. 1 is a schematic illustration of a gas turbine engine 10 having a centerline or longitudinal axis 11 and including a fan assembly 12, a high-pressure compressor 14, and a combustor 16. The engine 10 also includes a high-pressure turbine 18, a low-pressure turbine 20, and a booster 22. Fan assembly 12 includes an array of fan blades 24 extending radially outward from a rotor disk 26. While the illustrated engine 10 is a turbofan engine, the principles described herein are applicable to any type of engine or machine having a combustor.

It is noted that, as used herein, the terms "axial" and "longitudinal" both refer to a direction parallel to the centerline axis 11, while "radial" refers to a direction perpendicular to the axial direction, and "tangential" or "circumferential" refers to a direction mutually perpendicular to the axial and radial directions. As used herein, the terms "forward" or "front" refer to a location relatively upstream in an air flow passing through or around a component, and the terms "aft" or "rear" refer to a location relatively downstream in an air flow passing through or around a component. The direction of this flow is shown by the arrow "F" in FIG. 1. These directional terms are used merely for convenience in description and do not require a particular orientation of the structures described thereby.

In operation, air flows through booster 22 and compressed air is supplied from booster 22 to high pressure compressor 14. The highly compressed air is delivered to combustor 16 where fuel is injected and burned. Airflow from the combustor 16 drives the turbines 18 and 20 and exits the engine 10 through a nozzle. The high-pressure turbine 18 drives the high-pressure compressor 14 through a first shaft, and the low-pressure turbine 20 drives the fan assembly 12 and booster 22 through a second shaft.

Figure 2:
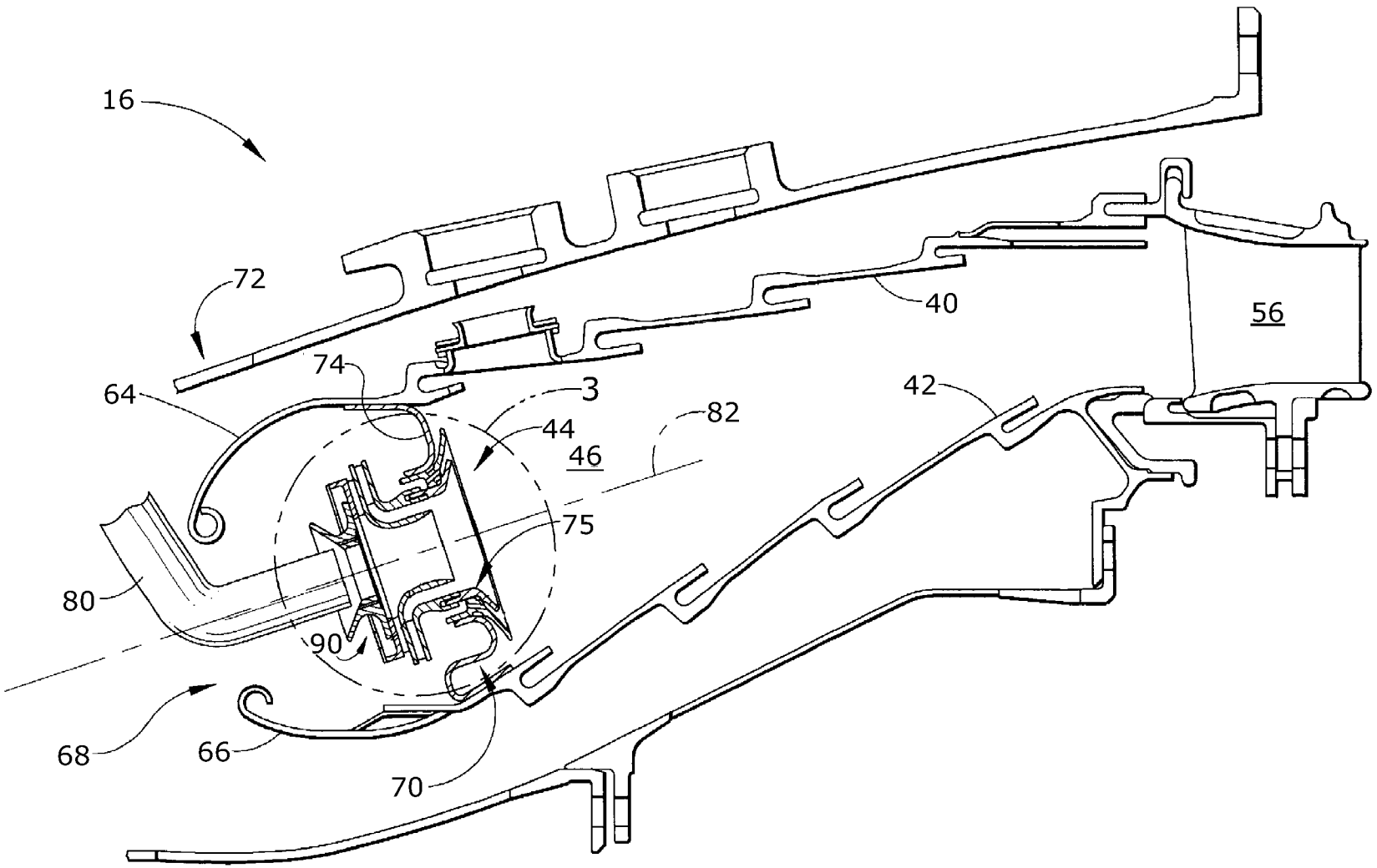
FIG. 2 is a schematic, half-sectional view of a combustor of the gas turbine engine shown in FIG. 1.

FIG. 2 is a cross-sectional view of the combustor 16. Combustor 16 includes an annular outer liner 40, an annular inner liner 42, and an upstream domed end or "dome" 44 extending between outer and inner liners 40 and 42, respectively. A combustion chamber 46 is defined between the outer liner 40 and the inner liner 42. the outer and inner liners 40 and 42 extend to a turbine nozzle 56 disposed downstream from combustor domed end 44.

Outer liner 40 and inner liner 42 include outer and inner cowls 64 and 66, respectively, which cooperate to define an opening 68.

In the exemplary embodiment, combustor domed end 44 includes an annular dome assembly 70 arranged in a single annular configuration. Other configurations such as double annular configuration or triple annular configurations are possible. Combustor dome assembly 70 provides structural support to a forward end 72 of combustor 16 and includes a dome plate or spectacle plate 74 and an array of deflector-flare cone assemblies 75.

The combustor 16 is supplied fuel via an array of fuel injectors 80 connected to a fuel source (not shown) and extending through combustor domed end 44. More specifically, the fuel injectors 80 extend through the dome assembly 70.

A swirler assembly 90 is disposed between each fuel injector 80 and the corresponding deflector-flare cone assembly 75.

Figure 3:
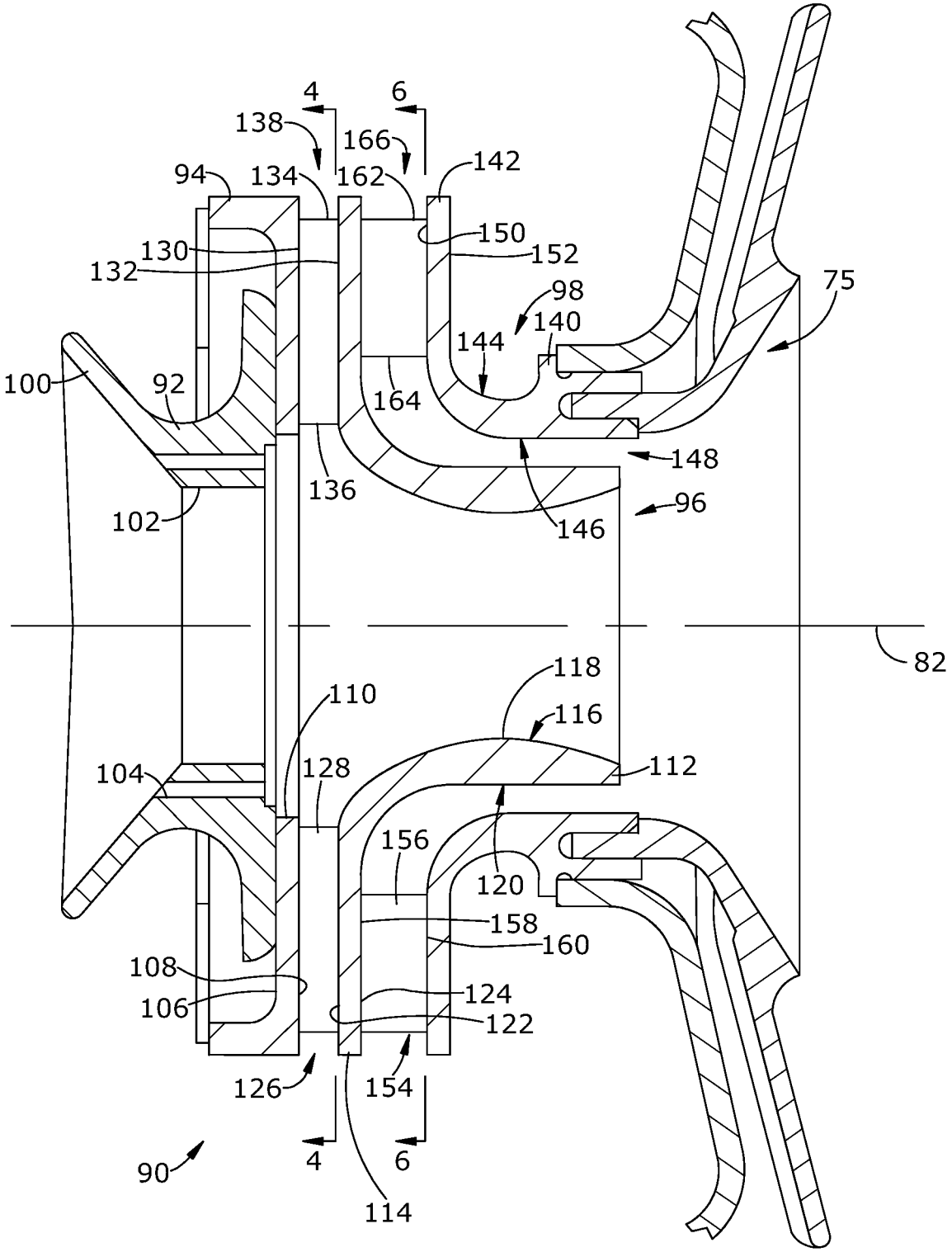
FIG. 3 is an enlarged view of a portion of the combustor of FIG. 2, showing a first exemplary swirler assembly.

FIG. 3 shows a representative swirler assembly 90 in more detail. The swirler assembly 90 includes, in axial sequence from forward to aft, a ferrule 92, a support plate 94, a venturi 96, and an annular exit cone 98, all disposed symmetrically about a swirler centerline 82.

The ferrule 92 is generally tubular, with a conical inlet flare 100 communicating with a central opening 102. In some embodiments the central opening 102 may be ringed by an array of axially-extending purge slots 104. Each one of the fuel injectors 80 (FIG. 2) is slidably disposed within a corresponding ferrule 92 to accommodate axial and radial thermal differential movement.

The support plate 94 is a disk-like structure having an upstream side 106 abutting the ferrule 92 and an opposed downstream side 108. A central opening 110 passes therethrough.

The venturi 96 includes a generally cylindrical venturi body 112 with an integrally formed outwardly extending venturi flange 114 at a forward end of the venturi body 112.

The venturi body 112 includes an inboard surface 116 which is convex in cross-sectional shape and defines a throat 118 of minimum flow area, and an opposed generally cylindrical outboard surface 120.

The venturi flange 114 includes an upstream surface 122 and an opposed downstream surface 124.

the venturi flange 114 is axially spaced away from the support plate 94 such that a primary swirler channel 126 is defined between the downstream side 108 of the support plate 94 and the upstream surface 122 of the venturi 96.

A plurality of primary swirl vanes 128 are arrayed around the swirler centerline 82 within the primary swirler channel 126. Each primary swirl vane 128 includes opposed sides. Each primary swirl vane 128 extends axially between a forward edge 130 at the downstream side 108 of the support plate 94 and an aft edge 132 at the upstream surface 122 of the venturi flange 96. Each primary swirl vane 128 is bounded by a leading edge 134 at its outboard extent and a trailing edge 136 at its inboard extent. Collectively, the primary swirler channel 126 with its primary swirl vanes 128 defines a "primary swirler" 138. The configuration of the primary swirl vanes 128 is described in more detail below.

The exit cone 98 includes a generally cylindrical body 140 with an integrally formed outwardly extending exit cone flange 142 at a forward end of the body 140. The body 140 includes a radially outer surface 144 and a radially inwardly facing flow surface 146. The body 140 is positioned outboard of and partially surrounding the venturi body 112.

The exit cone flow surface 146 and the venturi outboard surface 120 define an aft venturi channel 148 used for channeling a portion of air therethrough and downstream. A downstream end of the body 140 of the exit cone 98 is coupled to the corresponding deflector-flare cone assembly 75.

The exit cone flange 142 includes an upstream surface 150 and an opposed downstream surface 152. The exit cone flange 142 is axially spaced away from the venturi flange 114 such that a secondary swirler channel 154 is defined between the downstream surface 124 of the venturi flange 114 and the upstream surface 150 of the exit cone flange 142.

A plurality of secondary swirl vanes 156 are arrayed around the swirler centerline 82 within the secondary swirler channel 154. Each secondary swirl vane 156 includes opposed sides. Each secondary swirl vane 156 extends axially between a forward edge 158 at the downstream surface 124 of the venturi flange 114 and an aft edge 160 at the upstream surface 150 of the exit cone flange 142. Each secondary swirl vane 156 is bounded by a leading edge 162 at its outboard extent and a trailing edge 164 at its inboard extent. Collectively, the secondary swirler channel 154 with its secondary swirl vanes 156 defines a "secondary swirler" 166. The configuration of the secondary swirl vanes 156 is described in more detail below.

During operation, primary swirl vanes 128 swirl air in a first direction and secondary swirl vanes 156 swirl air in a second direction opposite to the first direction. Fuel discharged from fuel injector 80 is injected into venturi 96 and is mixed with air being swirled by primary swirl vanes 128. This initial mixture of fuel and air is discharged aft from venturi 96 and is mixed with air swirled through secondary swirl vanes 156. The fuel/air mixture is spread radially outwardly due to the centrifugal effects of swirl vanes 128, 156, and flows along flare cone-deflector assembly 75 at a relatively wide discharge spray angle.

Figure 4:
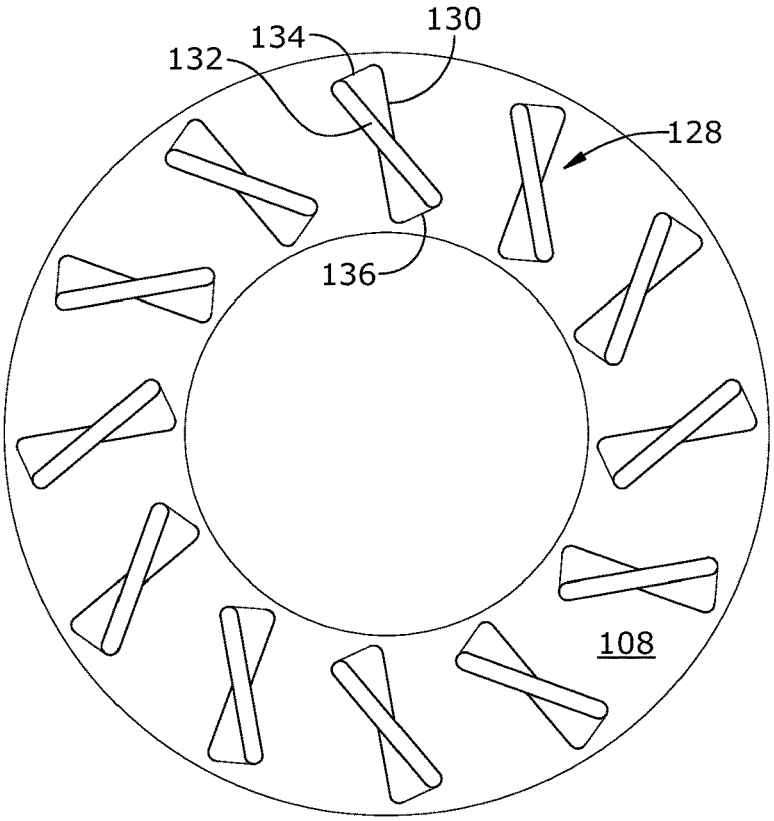
FIG. 4 is a view taken along lines 4-4 of FIG. 3.
Figure 5:
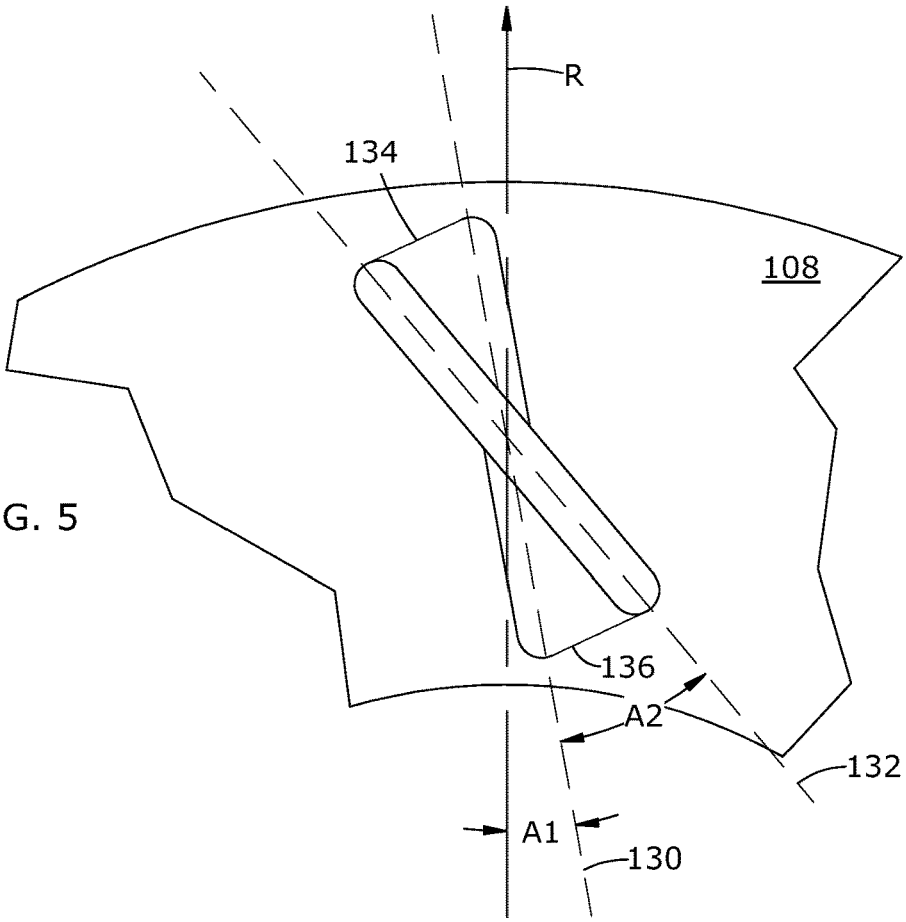
FIG. 5 is an enlarged view of a portion of FIG. 4.

FIGS. 4 and 5 illustrate the primary swirl vanes 128 of the primary swirler 138. Referring to FIG. 5 in particular, each of the primary swirl vanes 128 is disposed at a "vane angle" measured between a radial direction "R" from the swirler centerline 82 and a camber line of the primary swirl vane 128. In this context, a vane angle of zero degrees (0°) represents a purely radial direction, which would theoretically impart no swirl. A vane angle of ninety degrees (90°) represents the vane extending in a purely tangential direction which would theoretically impart the maximum tangential velocity component ("swirl"). It will be understood that the vane angle is the absolute value of the measurement and that a vane may be angled to either side of the radial direction R. In other words, a swirler may produce clockwise swirl or counterclockwise swirled relative to the swirler centerline 82. In practice, vane angles are typically greater than 0° and less than 90°.

One purpose of the present invention is to optimize the swirling flow created by the swirler over the entire flow area of the flow channel, providing jet stability, controlled flow distribution, and/or improved component durability. To this end, the primary swirl vanes 128 may incorporate a 3-D aero configuration, more specifically 3-D low-swirl primary swirl vanes 128 may provide a variable swirl component from the forward to the aft trailing edges of the primary swirl vanes 128. Stated another way, the vane angle may vary from the forward edge 130 to the aft edge 132. As best seen in FIG. 5, the forward edge 130 is disposed at a forward vane angle A1, and the aft edge 132 is disposed at an aft vane angle A2. In the illustrated example, the primary swirl vanes 128 do not incorporate camber and thus are shown as having a constant vane angle from the leading edge 134 to the trailing edge 136 for any given cross-section. It will be understood that the vane angle of interest for the purpose of the present invention is generally the angle at the inboard portion of the primary swirl vane 128, adjacent the trailing edge 136, where air is discharged from the primary swirl vanes 128. It will further be understood that the swirl vanes 128 may incorporate nonzero camber and thus may have a vane angle that varies from the leading edge 134 to the trailing edge 136.

In one example, a desirable effect results from making the forward vane angle A1 less than the aft vane angle A2. This configuration provides low or non-swirled radial inflow to the forward/central portion of the primary swirler channel 126. This will have a technical effect of decoupling the vane flow from the ferrule purge jets, and significantly reducing or eliminating jet instability and dynamics. This will also have a technical effect of decoupling the front end of the swirler flow field from the precessing vortex core and reducing or eliminating the associated axial flow dynamics.

This configuration will further have a technical effect of providing highly swirled in-flow to the aft/outer portion of the primary swirler channel 126, to prevent flow separation from the forward radius of the venturi, hence reducing the risk of autoignition.

The transition from low to high vane angle enables shaping of angular velocity profiles to provide a more controlled flow distribution, better flow turning and reduced local pressure gradients in the primary swirler passage, which can reduce combustion dynamics.

This swirl vane configuration also increases the pressure drop across the primary swirl vanes, which has been shown to reduce dynamics by reducing communication and coupling with the upstream dome region.

Various specific configurations incorporating this concept are possible.

In one example, the aft vane angle A2 may be about 30° to about 50° greater than the forward vane angle A1.

Where used herein, terms of approximation such as "about" or "approximately" are intended to encompass the stated numerical value as well as values greater than or less than the stated value which may occur, for example, as a result of manufacturing variations or measurement uncertainty. If not explicitly stated otherwise, the term "about" or "approximately" includes the stated value plus or minus 10% of the stated value.

In one example, the forward vane angle A1 may be about 0° to about 10°, and the aft vane angle A2 may be about 40° to about 50°.

In one example, the forward vane angle A1 may be about 10°, and the aft vane angle A2 may be about 40°.

In another example, the forward vane angle A1 may be about 0°, and the aft vane angle A2 may be about 50°.

In another example, a desirable effect results from making the forward vane angle A1 greater than the aft vane angle A2.

In another example, a desirable effect results from making the forward vane angle A1 substantially equal to the aft vane angle A2, with both vane angles being significantly less than vane angles used for similar vanes in the prior art.

In one example, the forward vane angle A1 may be less than 40° and the aft vane angle A2 may less than 40°.

In another example, the forward vane angle A1 may be about 10° to about 20°, and the aft vane angle A2 may be about 10° about 20°.

Figure 6:
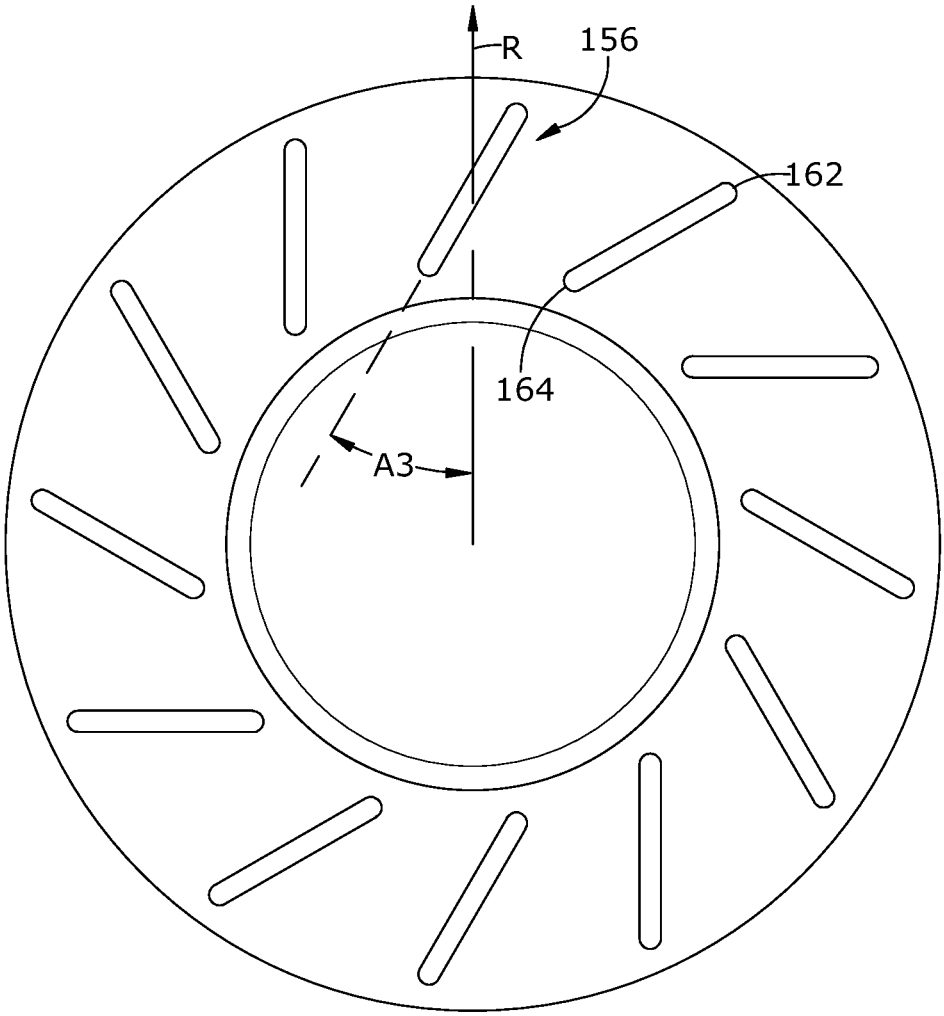
FIG. 6 is a view taken along lines 6-6 of FIG. 3.

FIG. 6 illustrates the secondary swirl vanes 156 of the secondary swirler 166. Each of the secondary swirl vanes 156 is disposed at a vane angle A3 measured between a radial direction "R" from the swirler centerline 82 and a camber line of the secondary swirl vane 156. As defined above. In this example, the secondary swirl vanes 156 have a constant vane angle A3.

Figure 7:
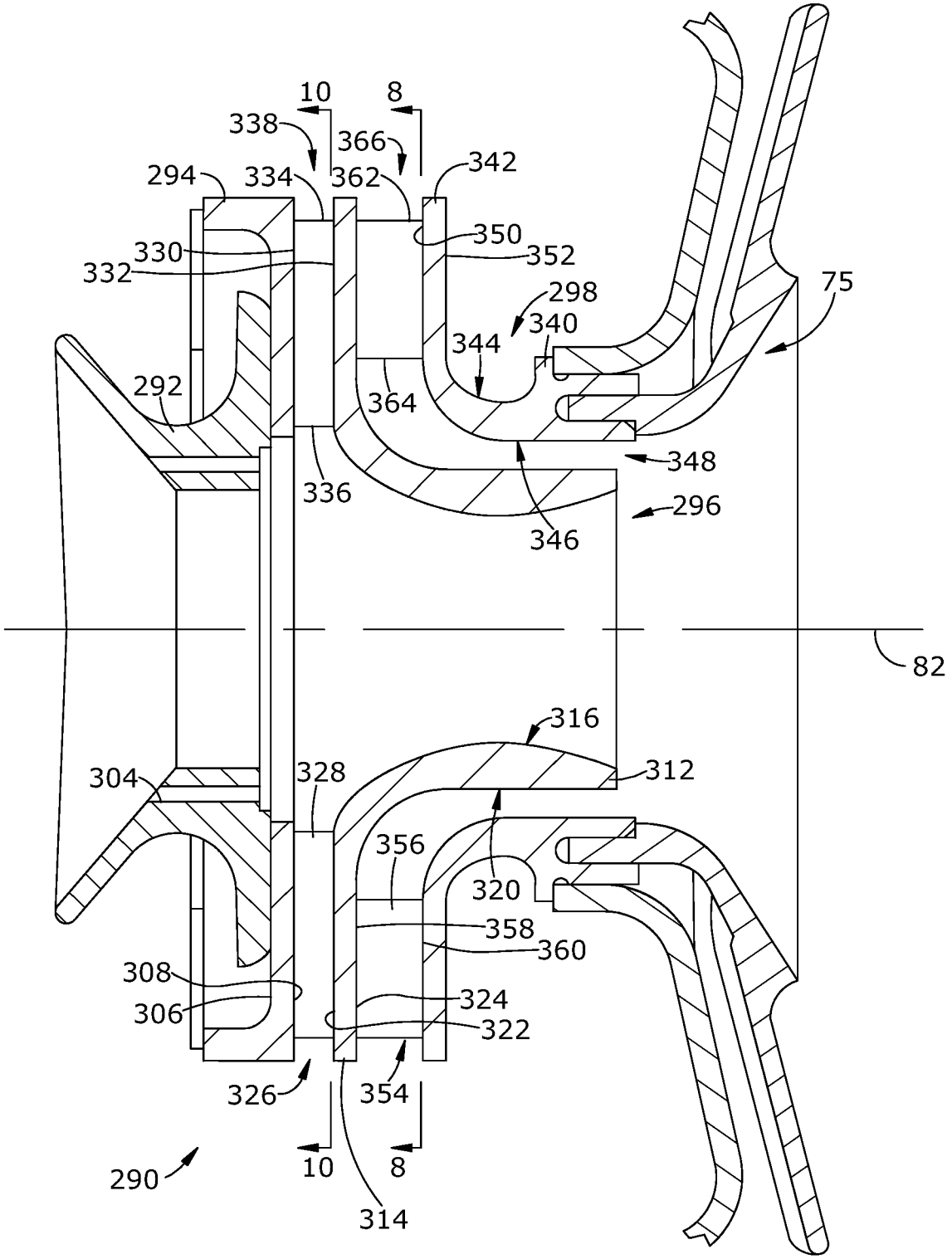
FIG. 7 is a cross-sectional view of a second exemplary swirler assembly suitable for use with the combustor of FIG. 2.

FIG. 7 illustrates an alternative swirler assembly 290. The swirler assembly 290 is similar in overall construction to the swirler assembly 90 described above. Elements of the swirler assembly 290 not explicitly described may be taken to be identical to corresponding components of the swirler assembly 90.

The swirler assembly 290 includes a ferrule 292, a support plate 294, a venturi 296, and an annular exit cone 298, all disposed symmetrically about a swirler centerline 82. In some embodiments the ferrule 292 may include an array of axially-extending purge slots 304.

The support plate 294 has an upstream side 306 and an opposed downstream side 308.

The venturi 296 includes a venturi body 312 having opposed inboard and outboard surfaces 316, 320 respectively, and a venturi flange 314 having upstream and downstream surfaces 322, 324 respectively.

A primary swirler channel 326 is defined between the downstream side 308 of the support plate to 294 and the upstream surface 322 of the venturi 296.

A plurality of primary swirl vanes 328 are arrayed around the swirler centerline 82 within the primary swirler channel 326. Each primary swirl vane 328 includes opposed sides. Each primary swirl vane 328 extends axially between a forward edge 330 and aft edge 332. Each primary swirl vane 328 is bounded by a leading edge 334 at its outboard extent and a trailing edge 336 at its inboard extent. Collectively, the primary swirler channel 326 with its primary swirl vanes 328 defines a "primary swirler" 338. The configuration of the primary swirl vanes 328 is described in more detail below.

The exit cone 298 includes a body 340 with an outer surface 344 and an opposed flow surface 346, and an exit cone flange 342 with opposed upstream and downstream surfaces 350, 352, respectively. The exit cone flow surface 346 and venturi outboard surface 316 define an aft venturi channel 348.

A secondary swirler channel 354 is defined between the downstream surface 324 of the venturi flange 314 and the upstream surface 350 of the exit cone flange 342.

A plurality of secondary swirl vanes 356 are arrayed around the swirler centerline within the secondary swirler channel 354. Each secondary swirl vane 356 includes opposed sides. Each secondary swirl vane 356 extends axially between a forward edge 358 and an aft edge 360. Each secondary swirl vane 356 is bounded by a leading edge 362 at its outboard extent and a trailing edge 364 at its inboard extent. Collectively, the secondary swirler channel 354 with its secondary swirl vanes 356 defines a "secondary swirler" 366. The configuration of the secondary swirl vanes 356 is described in more detail below.

Figure 8:
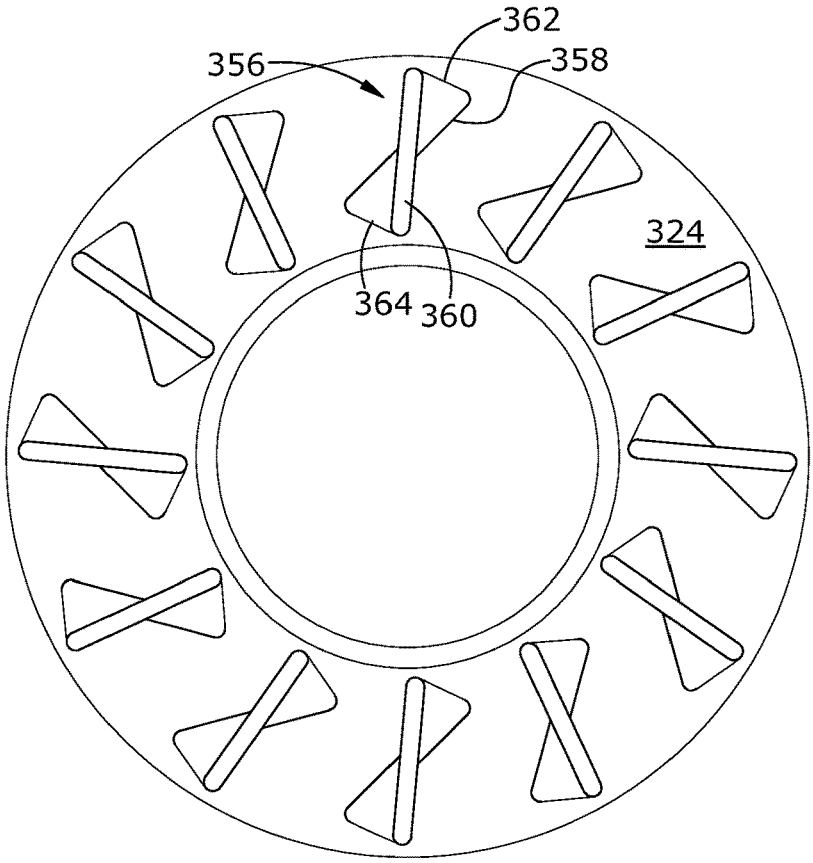
FIG. 8 is a view taken along lines 8-8 of FIG. 7.
Figure 9:
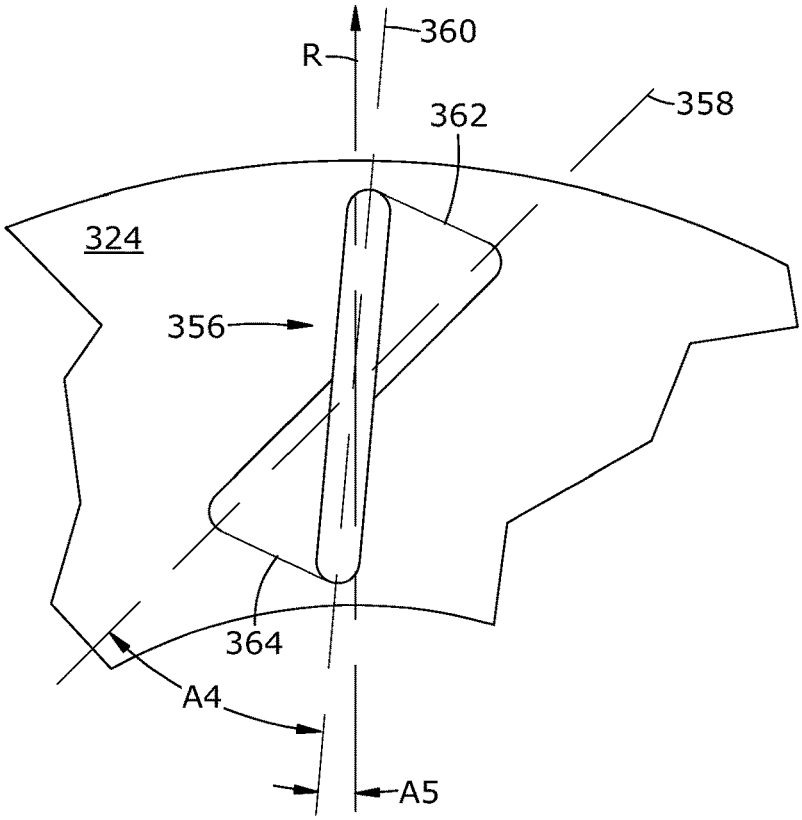
FIG. 9 is an enlarged view of a portion of FIG. 8.

FIGS. 8 and 9 illustrate the secondary swirl vanes 356 of the secondary swirler 366. Referring to FIG. 9 in particular, each of the secondary swirl vanes 356 is disposed at a "vane angle" measured as described above.

The secondary swirl vanes 356 may incorporate a 3-D aero configuration, more specifically 3-D secondary swirl vanes 356 may provide a variable swirl component from the forward to the aft trailing edges of the secondary swirl vanes 356. Stated another way, the vane angle may vary from the forward edge 358 to the aft edge 360. Various specific configurations incorporating this concept are possible.

As best seen in FIG. 9, the forward edge 358 is disposed at a forward vane angle A4, and the aft edge 360 is disposed at an aft vane angle A5.

In one example, the forward vane angle A4 may be about 45° to about 75°, and the aft vane angle A5 may be about 45° to about 75°.

In one example, a desirable effect results from making the forward vane angle A4 greater than the aft vane angle A5. This configuration will have a technical effect of providing high swirl adjacent to the inner secondary passage wall to and increasing shear, providing enhanced mixing, and therefore lower emissions (lower NOx, lower CO, lower HC), and low swirl adjacent to the outer secondary passage wall to reduce liner scrubbing and improve liner durability. It also permits tailored outer secondary swirl to slightly exceed flare cone expansion angle and therefore not separate for improved flare cone durability.

In one example, the forward vane angle A4 is greater than the aft vane angle A5, and the difference between the forward vane angle A4 and the aft vane angle A5 may be about 10° to about 30°.

In one example, the forward vane angle A4 may be about 75°, and the aft vane angle A5 may be about 45°.

In one example, the forward vane angle A4 may be about 65°, and the aft vane angle A5 may be about 55°.

Alternatively, a desirable effect may result from making the forward vane angle A4 less than the aft vane angle A5.

In one example, the forward vane angle A4 is less than the aft vane angle A5, and the difference between the forward vane angle A4 and the aft vane angle A5 may be about 10° to about 30°.

In one example, the forward vane angle A4 may be about 55°, and the aft vane angle A5 may be about 65°.

In one example, the forward vane angle A4 may be about 45°, and the aft vane angle A5 may be about 75°.

Figure 10:
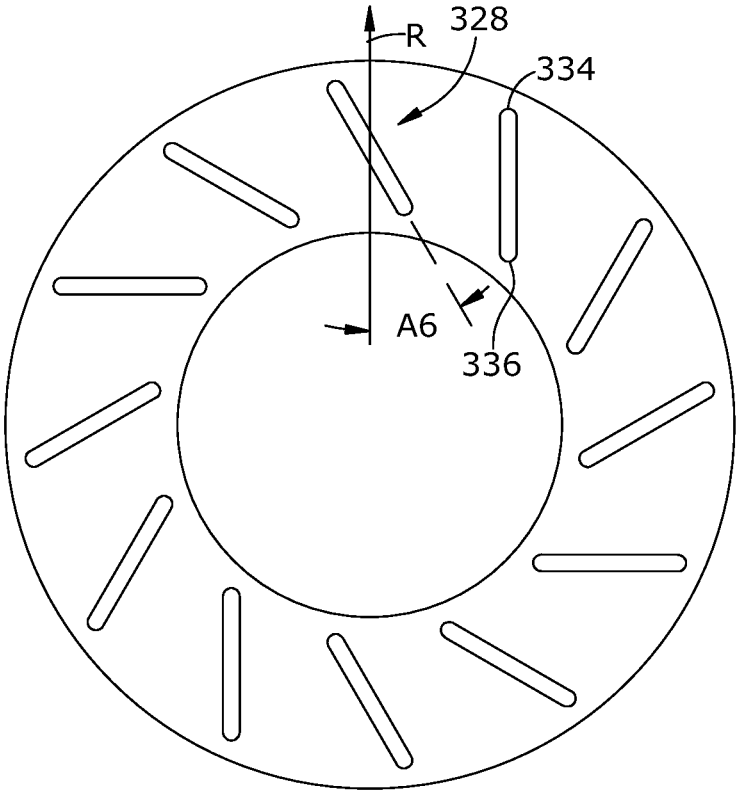
FIG. 10 is a view taken along lines 10-10 of FIG. 7.

FIG. 10 illustrates the primary swirl vanes 328 of the primary swirler 338. Each of the primary swirl vanes 328 is disposed at a vane angle measured between a radial direction "R" from the swirler centerline 82 and a camber line of the primary swirl vane 328, as defined above. In this example, the primary swirl vanes 328 have a constant vane angle A6.

Exemplary embodiments of swirler assemblies have been described above in which either a primary or secondary swirler includes 3-D aero swirl vanes embodying a varying vane angle. These concepts may be used alone or in combination. For example, a swirler assembly (not shown) could be constructed using the primary swirler 338 of the embodiment shown in FIGS. 3-6 above in the same swirler assembly as the secondary swirler 366 of the embodiment shown in FIGS. 7-9 above.

The foregoing has described a swirler assembly for a combustor. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

Further aspects of the invention are provided by the subject matter of the following numbered clauses:

1. A swirler apparatus for a combustor, comprising: primary and secondary swirlers disposed axially adjacent to each other along a swirler centerline; the primary swirler including a plurality of primary swirl vanes arrayed around the swirler centerline, each primary swirl vane including opposed sides bounded between opposed forward and aft edges and opposed leading and trailing edges, wherein the forward edge is oriented at a first vane angle with respect to a radial direction; wherein the aft edge is oriented at a second vane angle with respect to the radial direction; wherein the second vane angle is different from the first vane angle; and the secondary swirler including a plurality of secondary swirl vanes arrayed around the swirler centerline.

2. The apparatus of any preceding clause further comprising a ferrule disposed upstream of the primary swirler.

3. The apparatus of any preceding clause wherein the ferrule includes a plurality of purge slots in fluid communication with the primary swirler.

4. The apparatus of any preceding clause further including a venturi body disposed downstream of the primary swirler.

5. The apparatus of any preceding clause further including a flare cone disposed downstream of the secondary swirler.

6. The apparatus of any preceding clause wherein the first vane angle is about 0 degrees to about 10 degrees; and the second vane angle is about 40 degrees to about 50 degrees.

7. The apparatus of any preceding clause, further comprising a ferrule disposed upstream of the primary swirler, the ferrule being free of purge slots.

8. The apparatus of any preceding clause wherein the second vane angle is about 30 to about 50 degrees greater than the first vane angle.

9. The apparatus of any preceding clause wherein the second vane angle is about 30 to about 50 degrees less than the first vane angle.

10. A combustor for a gas turbine engine, comprising: an annular inner liner; an annular outer liner spaced apart from the inner liner; a domed end disposed at an upstream end of the inner and outer liners, the domed end including an annular dome; the dome including an annular array of swirler assemblies, each swirler assembly having primary and secondary swirlers disposed axially adjacent to each other along a swirler centerline; the primary swirler including a plurality of primary swirl vanes arrayed around the swirler centerline, each primary swirl vane including opposed sides bounded between opposed forward and aft edges and opposed leading and trailing edges, wherein the forward edge is oriented at a first vane angle with respect to a radial direction; wherein the aft edge is oriented at a second vane angle with respect to the radial direction; wherein the second vane angle is different from the first vane angle; and the secondary swirler including a plurality of secondary swirl vanes arrayed around the swirler centerline.

11. The apparatus of claim 10 further comprising a ferrule disposed upstream of the primary swirler.

12. The apparatus of any preceding clause wherein the ferrule includes a plurality of purge slots in fluid communication with the primary swirler.

13. The apparatus of any preceding clause further including a venturi body disposed downstream of the primary swirler.

14. The apparatus of any preceding clause further including a flare cone disposed downstream of the secondary swirler.

15. The apparatus of any preceding clause wherein the first vane angle is about 0 degrees to about 10 degrees; and the second vane angle is about 40 degrees to about 50 degrees.

16. The apparatus of any preceding clause, further comprising a ferrule disposed upstream of the primary swirler, the ferrule being free of purge slots.

17. The apparatus of any preceding clause wherein the second vane angle is about 30 to about 50 degrees greater than the first vane angle.

18. The apparatus of any preceding clause wherein the second vane angle is about 30 to about 50 degrees less than the first vane angle.

19. A swirler apparatus for a combustor, comprising: primary and secondary swirlers disposed axially adjacent to each other along a swirler centerline; the primary swirler including a plurality of primary swirl vanes arrayed around the swirler centerline, each primary swirl vane including opposed sides bounded between opposed forward and aft edges and opposed leading and trailing edges, wherein the forward edge is oriented at a first vane angle with respect to a radial direction of less than 40 degrees; wherein the aft edge is oriented at a second vane angle with respect to the radial direction of less than 40 degrees; the secondary swirler including a plurality of secondary swirl vanes arrayed around the swirler centerline.

20. The apparatus of any preceding clause wherein the first vane angle is about 10 to about 20 degrees; and the second vane angle is about 10 to about 20 degrees.

21. The apparatus of any preceding clause wherein the first vane angle is equal to the second vane angle.

What is claimed is:

1. A swirler apparatus for a combustor, comprising:

a primary swirler and a secondary swirler disposed axially adjacent to each other along a swirler centerline;

the primary swirler including a plurality of primary swirl vanes arrayed around the swirler centerline, each primary swirl vane including opposed sides bounded between a forward edge and an aft edge and between a leading edge and a trailing edge, wherein the forward edge of each primary swirl vane is oriented at a first vane angle with respect to a radial direction, the aft edge of each primary swirl vane is oriented at a second vane angle with respect to the radial direction, and the second vane angle is different from the first vane angle; and the secondary swirler including a plurality of secondary swirl vanes arrayed around the swirler centerline, each secondary swirl vane including opposed sides between a forward edge and an aft edge and between a leading edge and a trailing edge, wherein the forward edge of each secondary swirl vane is oriented at a third vane angle with respect to the radial direction, the aft edge of each secondary swirl vane is oriented at a fourth vane angle with respect to the radial direction, and the third vane angle is different from the fourth vane angle.

2. The swirler apparatus of claim 1, further comprising a ferrule disposed upstream of the primary swirler.

3. The swirler apparatus of claim 2, wherein the ferrule includes a plurality of purge slots in fluid communication with the primary swirler.

4. The swirler apparatus of claim 2, further including a venturi body disposed downstream of the primary swirler.

5. The swirler apparatus of claim 1, further including a flare cone disposed downstream of the secondary swirler.

6. The swirler apparatus of claim 1, wherein the first vane angle is about 0 degrees to about 10 degrees; and the second vane angle is about 40 degrees to about 50 degrees.

7. The swirler apparatus of claim 6, further comprising a ferrule disposed upstream of the primary swirler, the ferrule being free of purge slots.

8. The swirler apparatus of claim 1, wherein the second vane angle is greater than the first vane angle.

9. The swirler apparatus of claim 1, wherein the second vane angle is less than the first vane angle.

10. A combustor for a gas turbine engine, comprising:

an annular inner liner;

an annular outer liner spaced apart from the annular inner liner;

a domed end disposed at an upstream end of the annular inner liner and the annular outer liner, the domed end including an annular dome;

the annular dome including an annular array of swirler assemblies, each swirler assembly having a primary swirler and a secondary swirler disposed axially adjacent to each other along a swirler centerline;

the primary swirler including a plurality of primary swirl vanes arrayed around the swirler centerline, each primary swirl vane including opposed sides bounded between a forward edge and an aft edge and between a leading edge and a trailing edge, wherein the forward edge is oriented at a first vane angle with respect to a radial direction, the aft edge is oriented at a second vane angle with respect to the radial direction, and the second vane angle is different from the first vane angle; and the secondary swirler including a plurality of secondary swirl vanes arrayed around the swirler centerline, each secondary swirl vane including opposed sides between a forward edge and an aft edge and between a leading edge and a trailing edge, wherein the forward edge of each secondary swirl vane is oriented at a third vane angle with respect to the radial direction, the aft edge of each secondary swirl vane is oriented at a fourth vane angle with respect to the radial direction, and the third vane angle is different from the fourth vane angle.

11. The combustor of claim 10, further comprising a ferrule disposed upstream of the primary swirler.

12. The combustor of claim 11, wherein the ferrule includes a plurality of purge slots in fluid communication with the primary swirler.

13. The combustor of claim 11, further including a venturi body disposed downstream of the primary swirler.

14. The combustor of claim 10, wherein the first vane angle is about 0 degrees to about 10 degrees; and the second vane angle is about 40 degrees to about 50 degrees.

15. The combustor of claim 14, further comprising a ferrule disposed upstream of the primary swirler, the ferrule being free of purge slots.

16. The combustor of claim 10, wherein the second vane angle is greater than the first vane angle.

17. The combustor of claim 10, wherein the second vane angle is less than the first vane angle.

18. A swirler apparatus for a combustor, comprising:

a primary swirler and a secondary swirler disposed axially adjacent to each other along a swirler centerline;

the primary swirler including a plurality of primary swirl vanes arrayed around the swirler centerline, each primary swirl vane including opposed sides bounded between a forward edge and an aft edge and between a leading edge and a trailing edge, wherein the forward edge is oriented at a first vane angle with respect to a radial direction of less than 40 degrees, wherein the aft edge is oriented at a second vane angle with respect to the radial direction of less than 40 degrees, and the second vane angle is different from the first vane angle; and the secondary swirler including a plurality of secondary swirl vanes arrayed around the swirler centerline, each secondary swirl vane including opposed sides between a forward edge and an aft edge and between a leading edge and a trailing edge, wherein the forward edge of each secondary swirl vane is oriented at a third vane angle with respect to the radial direction, the aft edge of each secondary swirl vane is oriented at a fourth vane angle with respect to the radial direction, and the third vane angle is different from the fourth vane angle.

19. The swirler apparatus of claim 18, wherein the first vane angle is about 10 to about 20 degrees; and the second vane angle is about 10 to about 20 degrees.

20. The swirler apparatus of claim 18, wherein the third vane angle is about 45 to about 75 degrees, and the fourth vane angle is about 45 to about 75 degrees.

* * * * *